United States Patent [19]

Doyel

[11] 4,209,870

[45] Jul. 1, 1980

[54] HAND-HELD CLEANING DEVICE WITH SNOUT-LIKE SWEEP TUNNEL

[76] Inventor: John S. Doyel, 404 W. 20th St., New York, N.Y. 10011

[21] Appl. No.: 2,786

[22] Filed: Jan. 11, 1979

[51] Int. Cl.[2] ..... A47L 11/00

[52] U.S. Cl. ..... 15/97 R; 15/22 B

[58] Field of Search ..... 15/22 B, 41, 49 R, 51, 15/80, 98, 99, 97 R, 344

[56] References Cited

U.S. PATENT DOCUMENTS

| | | | |
|---|---|---|---|
| 1,200,092 | 10/1916 | Elliott et al. | 15/80 |
| 3,252,175 | 5/1966 | Pedersen | 15/22 B |
| 3,308,498 | 3/1967 | Evans, Jr. | 15/23 |
| 3,368,231 | 2/1968 | Kravos et al. | 15/344 |
| 3,872,539 | 3/1975 | Doyel | 15/344 |

*Primary Examiner*—Edward L. Roberts

*Attorney, Agent, or Firm*—Cooper, Dunham, Clark, Griffin & Moran

[57] ABSTRACT

A hand-held cleaning device is disclosed comprising a two-piece, molded plastic housing having a top handle and a forwardly-extending snout-like sweep tunnel with a forwardly-inclined intake opening at its forward end and containing a driveable endless belt with spaced flexible sweeping blades thereon which pick up dust and debris at the intake opening and carry it through the tunnel to a material-receiving chamber within the housing. An illuminating system is located in the housing above the tunnel for alternately acting as a flashlight or a beacon, and a debris cup is removably mounted on the underside of the housing for collecting and disposing of material from the material-receiving chamber, which cup may also act as a prop for inclinedly supporting the device on a flat surface when the illuminating system is being used. Power cells and an electric motor are mounted within partitions molded integrally with the axially-mating housing halves, and respective switching arrangements are provided for energizing the electric motor and the illuminating system.

22 Claims, 14 Drawing Figures

Fig. 5.
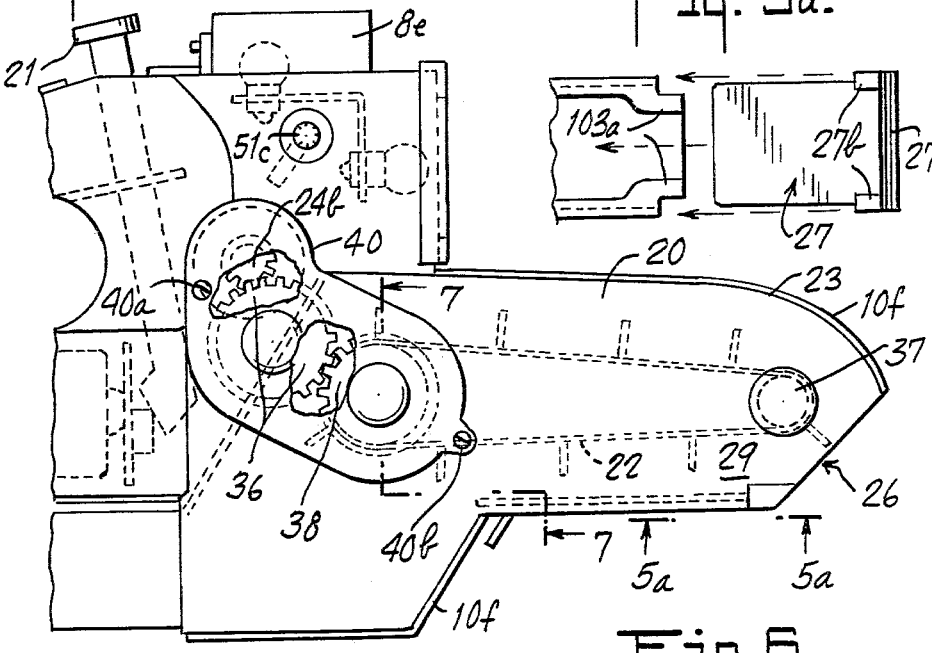
Fig. 5a.
Fig. 6.
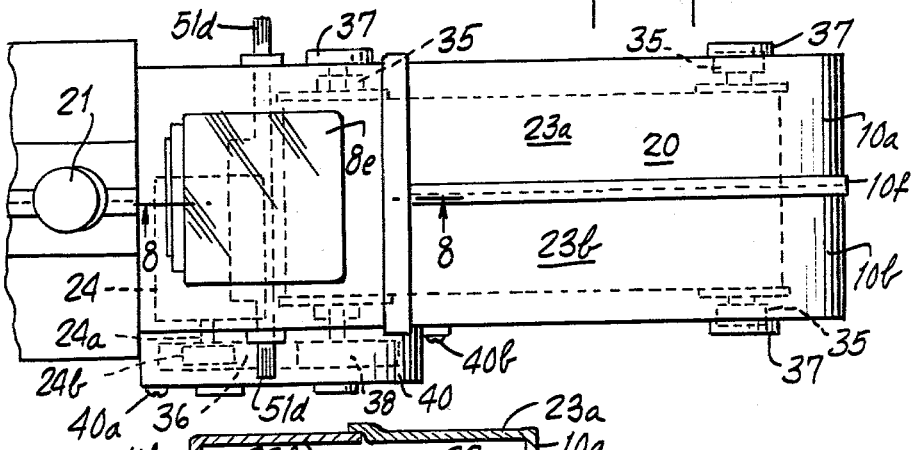
Fig. 7.
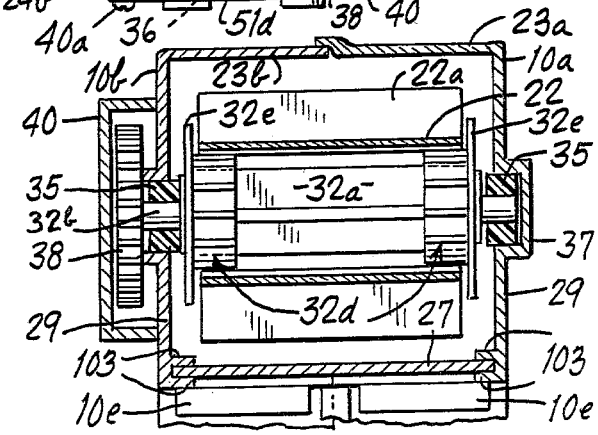

Fig. 8.
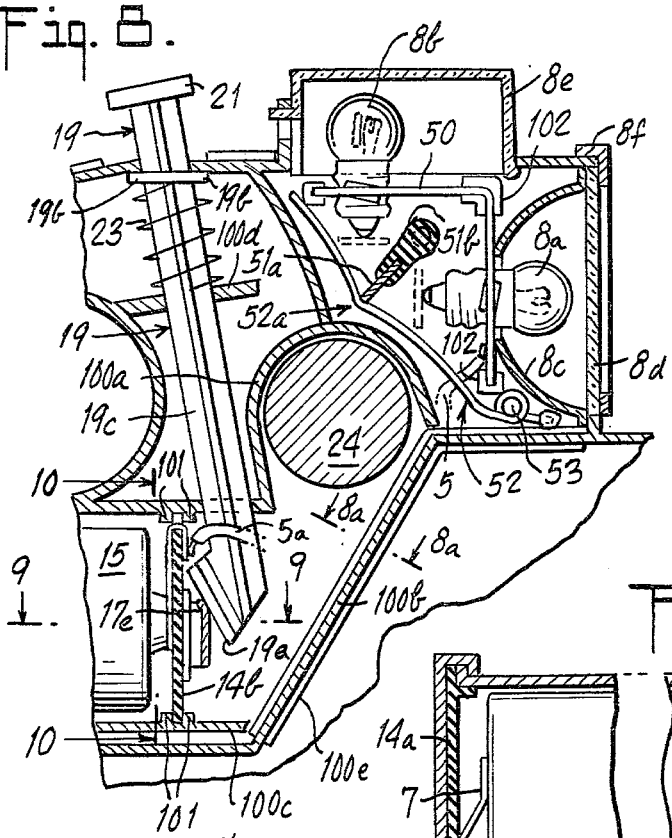
Fig. 8a.
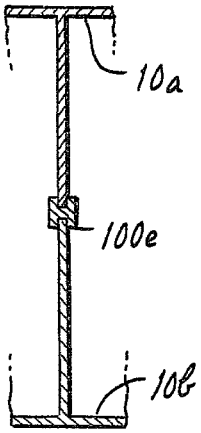
Fig. 9.
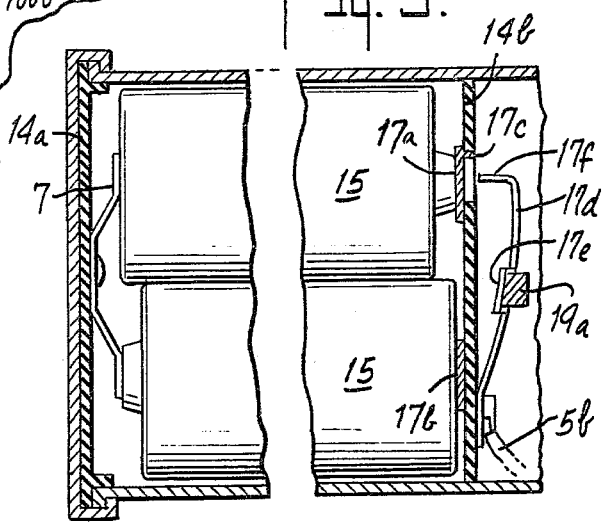
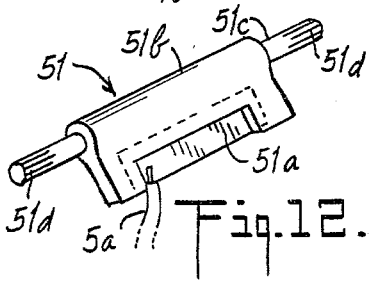
Fig. 12.
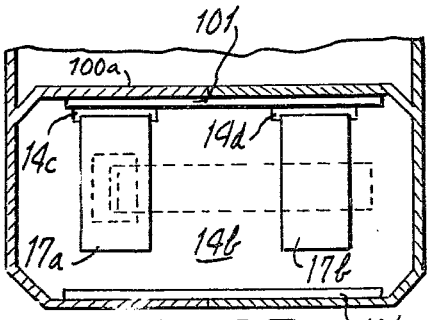
Fig. 10.
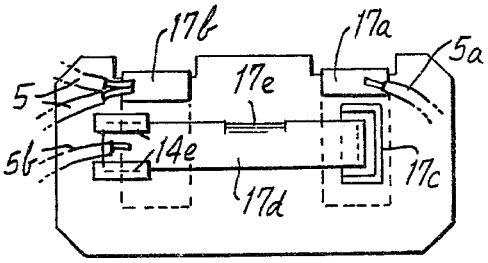
Fig. 11.

HAND-HELD CLEANING DEVICE WITH SNOUT-LIKE SWEEP TUNNEL

BACKGROUND OF THE INVENTION

The present invention relates to the field of mechanical cleaning devices which utilize a sweeping or broom action for removing dust and other particles from the surfaces of such objects as carpets, clothing, furniture, and the like and particularly involves a battery-operated hand-held cleaning device for accomplishing such purposes efficiently and inexpensively.

The present invention is intended for performing many operations for which large conventional carpet sweepers and electric brooms may be found to be inconvenient, impractical or undesirable. For example, conventional sweepers and electric brooms are often too bulky and require too much time and effort to take out of a closet or other storage area and prepare for use for minor jobs such as clothes brushing, cleaning dust or particles from a table top, cleaning car seats and carpeting, or cleaning a small area of a rug. As a result, small portable battery-operated devices have been developed for such uses. Examples of such devices are set forth in my prior U.S. Pat. No. 3,872,539 and in the U.S. patents to Kravos et al, U.S. Pat. No. 3,368,231, and Evans Jr., U.S. Pat. No. 3,308,498, both of which disclose clothes brushes which are portable and battery-operated. Other generally similar construction used for hair brushing disclosed in U.S. Pat. No. 3,252,175 to Pedersen.

Desirable features in devices of the type to which the present invention is directed are minimum size and weight for convenience and ease of operation; suitable configuration for versatility; minimum power consumption so that the batteries will last longer; maximum efficiency in sweeping action so that the device will effectively pick up dirt and other particles; and sturdy materials and simple construction which minimize cost and maximize durability. Since achieving all of these features may involve many trade-offs, the ultimate goal in designing and manufacturing such a device is a combination of components which will optimize the desired results.

The present invention combines the components of a hand-held battery-operated cleaning device in such a manner that the device is compact, convenient to use, versatile, low in power consumption, efficient in operation, and inexpensive to manufacture and maintain. In contrast to the device disclosed in my prior U.S. Pat. No. 3,872,539, it is particularly adapted for use in cleaning corners and other snug areas, as well as irregular surfaces, so that it is suitable for cleaning the interiors of automobiles, and accordingly is provided with a combination of additional components which enhance its utility and versatility in this regard.

SUMMARY OF THE INVENTION

The present invention comprehends a cleaning device comprising a method plastic housing provided with a top handle adapted for gripping by the hand of a user and including a forwardly-extending snout-like sweep tunnel. The tunnel has a forwardly-inclined intake opening at one end and a material-receiving chamber within the housing at the other end and contains a driveable endless belt with spaced flexible sweeping blades thereon. An electric motor is mounted in the housing behind the sweep tunnel, with its drive shaft extending through one side of the housing for driving the endless belt through a transfer gearing system disposed on the outside of the housing beneath an appropriate cover. The motor is powered by batteries, carried in the rear portion of the housing, that are connected to the motor through an improved on-off switch arrangement operated by a push-button at the top of the housing. The forward upper portion of the housing may be provided with two small light bulbs, one for directing light forwardly through an appropriate lens above the sweep tunnel to act as a flashlight, and the other for directing flashing light upwardly through a dome lens to act as a lighted marker or beacon. The two bulbs may be alternately energized through an improved simple spring switch arrangement. A dust and debris cup is removably attached at the under side of the housing to receive the material swept up into the sweep tunnel and deposited in the material-receiving chamber at the rear of the tunnel, and the exit of the chamber is provided with an appropriate baffle to avoid spill back of the material already deposited in the cup. The underside of the sweep tunnel may be provided with means for cooperating with the removable debris cup to prop the device at an angle on a level surface to facilitate its use as a flashlight or beacon. All of the components are simply constructed and compactly combined in a manner providing inexpensive manufacture and maintenance, as well as excellent durability.

In operation, the motor is energized, upon depression of the push-button on the top of the housing, and drives the endless belt to cause the flexible blades disposed thereon to pick up and sweep backwardly into the sweep tunnel any dust or particles that appear at the intake opening. The tunnel is manipulated and pressed against any surface to be cleaned with the intake opening engaging the surface. The flexible blades are dimensioned so as not to extend outwardly of the intake opening so that they do not normally touch the surface being cleaned or the inner walls of the tunnel. Thus, loss of power due to friction between the blades and the tunnel chamber or the surface being cleaned is minimized. When the device is used in unlighted areas, such as under the seats of an automobile, the forwardly-directed flashlight bulb may be lighted to illuminate the area being cleaned. The other bulb may alternately be lighted to use the device as a marker or beacon in association with an automobile.

BRIEF DESCRIPTION OF THE DRAWINGS

FIG. 5 is a side view of the forward portion of the cleaning device taken from the side opposite that of FIG. 1.

FIG. 5*a* is a view taken along the lines 5*a*—5*a* in FIG. 5 illustrating the fitting of the lower wall to the underside of the sweep tunnel.

FIG. 6 is a top view of the forward portion of the device shown in FIG. 5.

FIG. 7 is a sectional view taken along the lines 7—7 in FIG. 5.

FIG. 8 is a partial sectional view taken generally along the lines 8—8 in FIG. 6 and illustrating the electrical switching in the device.

FIG. 8*a* is a sectional view taken along the lines 8*a*—8*a* in FIG. 8 illustrating an interior joint between the housing halves.

FIG. 9 is a partial sectional view taken along the lines 9—9 in FIG. 8.

FIG. 10 is a sectional view taken along the lines 10—10 in FIG. 8 illustrating the battery contact arrangement.

FIG. 11 is a view of the battery contact arrangement taken from the side opposite that of FIG. 10.

FIG. 12 is a perspective view of the operating switch contact for use with the lighting apparatus in the cleaning device of the present invention.

DETAILED DESCRIPTION

Figures 1, 2, 3, 4:
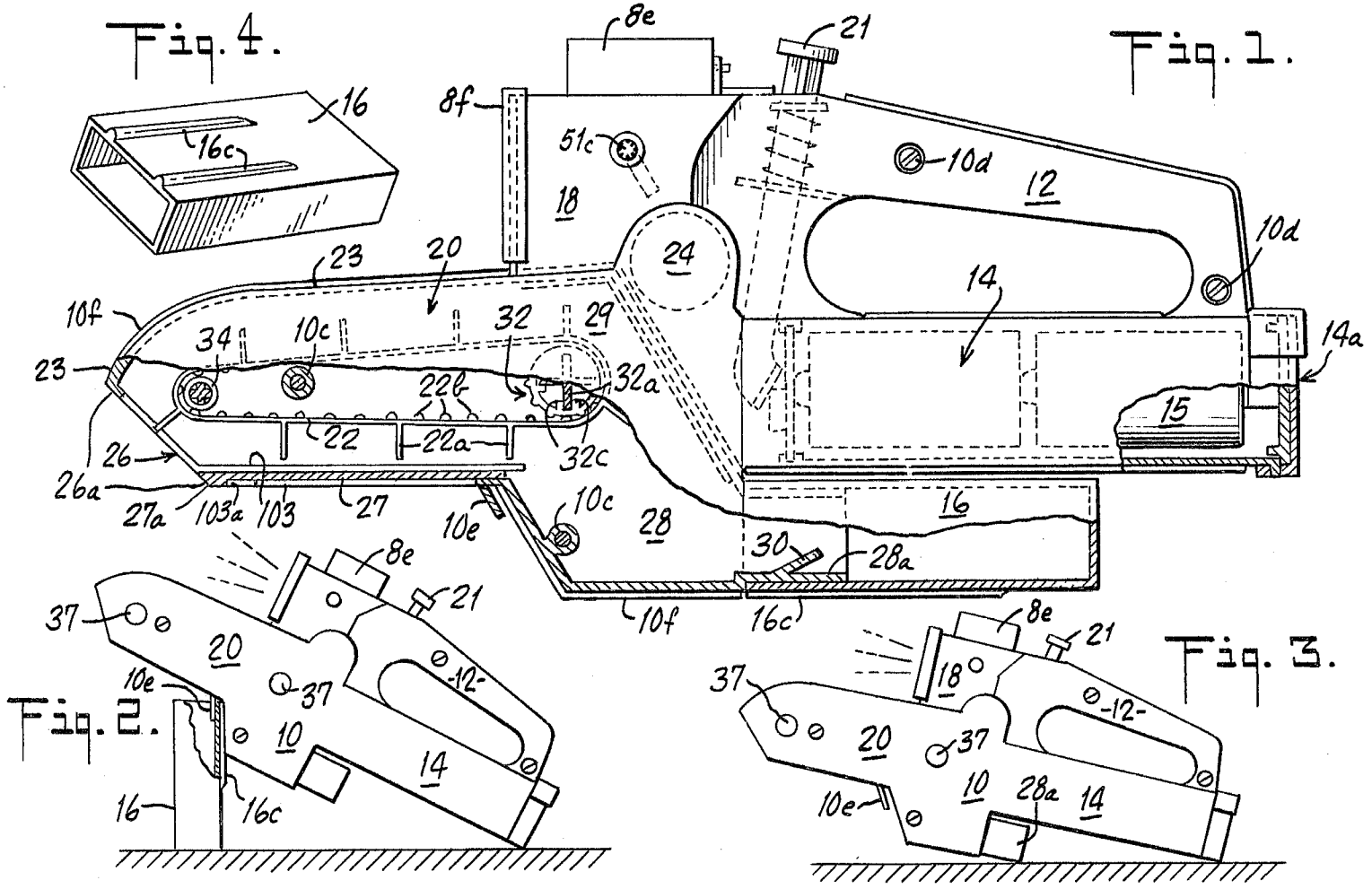
FIG. 1 is a side view, with portions broken away to reveal interior details, of a cleaning device constructed in accordance with the present invention.
FIGS. 2 and 3 are side views of the device in FIG. 1 illustrating the alternative positioning of the device when used for lighting or beacon purposes.
FIG. 4 is a perspective view of the removable debris cup which receives the material cleaned by the device and which may be used as a prop in the manner shown in FIG. 2.

Referring to FIG. 1, a cleaning device in accordance with the present invention is shown comprising a hollow two-piece housing 10 which may be formed of a molded thermoplastic material such as high-impact polystyrene and which includes a handle 12 adapted to be gripped by the hand of a user; a battery compartment 14 containing a suitable set of power cells 15; a removably secured debris cup 16 for collecting and disposing of dust and other particles; an upper lighting compartment 18; and a forwardly-extending sweep tunnel 20, containing a driven endless sweeping belt 22 powered by a small electric motor 24. The front end of the sweep tunnel 20 has a forwardly-inclined rectangular intake opening 26 whose periphery **26*a* is placed against and/or passed over a surface to be cleaned. The upstanding blades 22*a* on the driven endless belt 22 pass by the opening 26 in their movement, without extending through it. Any dust and particles that appear at the intake opening are picked up and carried by the blades 22*a* back along the lower wall of the tunnel 20. The dust and particles are thus swept from the engaged surface, by the sweeping belt 22, mechanically in a broom-like action, through the tunnel into a material-receiving chamber 28 at its opposite end and ultimately are collected in the debris cup 16 which is attached to and communicates with the material receiving chamber 28. A rearwardly-inclined transversely-extending lip 30 is formed within exit portion 28*a* of the material-receiving chamber 28** to impede the return to the chamber of any contents collected in the debris cup that might roll forwardly upon forward tilting of the device.

The sweep tunnel is formed of a removable flat lower wall 27, flat upstanding side walls 29, and a top wall 23. The top wall 23 is formed by mating flat walls **23*a* and 23*b* of the housing (see FIG. 7). The walls 23*a*, 23*b* are curved at their forward ends and extend beyond the forward end of lower wall 27 and cooperate with it and the forward ends of the side walls 29 to form the forwardly-inclined intake opening 26**. The resulting snout-like configuration facilitates the insertion and manipulation of the tunnel in snug areas and the engagement of the intake opening with irregular surfaces.

The endless sweeping belt 22 is of a flexible plastic material, such as vinyl, with the upstanding flexible sweeping blades **22*a* suitably spaced and integrally formed on its outer surface and with a series of integrally formed transverse ribs 22*b* on its inner surface which cooperate with the teeth of a drive gear 32 and pass over an idler roller 34 on which the belt 22 is mounted. The gear shaft 32*a* and roller shaft 34*a* have extensions 32*b* and 34*b* on their opposite ends journaled in simple plastic bearings 35 supported in indentations or bosses 37 on the sidewalls 29 of the tunnel 20. The sweeping belt and blades are mounted with clearances between them and the interior walls of the sweep tunnel 20 so that during operation there is movement comparatively free of any frictional drag on the belt from the surrounding parts as well as the surface being cleaned. The flexibility of the blades also tends to avoid jamming or overloading of the belt by particles too large or heavy to enter the sweep tunnel 20**, as the blades will bend and slide past such obstructions.

The belt 22 is driven by means of the small electric motor 24 through a suitable gear system shown in detail in FIGS. 5 and 7. The output shaft **24*a* of the motor is provided with a small gear 24*b* which cooperates with a larger, transfer gear 36 mounted on the side of the housing 10. The transfer gear 36 transfers the imposed rotational force on a one-to-one basis to a matching second gear 38, also disposed on the outside of the housing, which latter gear is fixed to the extension 32*b* on the gear shaft 32*a* of the drive gear 32. Drive gear 32 comprises two gear elements 32*d* mounted on the opposite ends of gear shaft 32*a* and abutted by hub flanges 32*e*. The gear shaft 32*a* is an elongated cruciform member whose transverse edges are received in and cooperate with ridges 32*c* on the interior surfaces of the drive gear elements 32*d* to transfer the rotational force through elements 32*d* to belt 22. Idler roller 34 is mounted in its shaft 34*a* by a similar construction. A protective cover member 40 is mounted over the external gear system and may be removably fastened to the outside of the housing by means of screws 40*a* and 40*b***. The simple gear system which may be of hard plastic, such as delrin, minimizes energy expenditure and may be easily assembled, maintained and removed. In addition, the transfer gear system is externally mounted with respect to the tunnel avoiding the danger of fouling by the swept dust and particles.

The motor 24 is energized by means of the batteries or power cells 15 which are held within the battery housing 14 and which are electrically connected to the motor through a circuit including an on-off switch arrangement shown in detail in FIGS. 8–11. Firstly, the rear wall **14*a* of the battery compartment 14 is provided with an insulating board having a conventional contact 7 for connecting the cells 15 in series, and the forward wall 14*b* is provided with an improved contact arrangement 17 which cooperates with a spring-loaded plunger 19 in the form of a ribbed rod 19*c* having a push-button 21 on its upper end extending through the upper wall of the housing 10. The improved contact arrangement 17 is mounted on an insulating board which forms the forward wall 14*b* of the battery compartment 15, and comprises two conductive members 17*a*, 17*b* which clip over cut-outs 14*c*, 14*d*, in the upper edges of the board 14*b*, and contact the poles of the respective cells 15 in the battery compartment. The clip-over portion of conductive member 17*b*, on the forward side of the board 14*b*, is connected to two common or ground wires 5 whose opposite ends are respectively connected to one side of the motor 24 and to a conductive angle member 50 upon which two bulbs 8*a*, 8*b*, for the illuminating system in lighting compartment 18, are mounted. The clip-over portion of the other conductive member 17*a* has a wire 5*a* connected thereto whose opposite end is connected to a switch operator 51, shown in detail in FIG. 12, for alternately energizing the two bulbs 8***a*, 8*b*. This latter conductive member 17*a* also has a portion 17*c* which extends through a cut-out in the insulating board 14*b* so as to permit member 17*a* to be conductively contacted by one end 17*f* of a conductive leaf spring 17*d*. The opposite end of the leaf spring 17*d*, which may be inserted into suitable tabs 14*e* formed on the insulating board 14*b* is connected to a wire 5*b* whose opposite end is connected to the other side of the motor 25 from the common wire 5. The central portion of the leaf spring 17*d* is provided with an indented cam portion 17*e* which cooperates with an inclined cam surface 19*a* formed on the lower end of the push-button plunger 19. It will be seen that the down-and-up action of the plunger 19 will, through the cooperation of the cam portion 17*e* and cam surface 19*a*, cause engagement and disengagement of the bent end 17*f* of spring 17*d* and the battery contact 17*a* to energize and deenergize the motor 24.

The two bulbs 8*a*, 8*b* in the illuminating system may be alternately illuminated by simple pivoting of the switch operator 51, which comprises a contact plate 51*a* connected to the wire 5*a* and embedded in an insulating member 51*b* that is fixed to a rotatable shaft 51*c* extending between and through the opposite walls of the housing 10. The operator 51 may be pivoted by means of knurled ends 51*d* on the shaft 51*c* outside of the opposite housing walls. The operator 51 is normally held in a neutral position out of contact with either of the bulbs 8*a*, 8*b* by means of a specially-shaped leaf spring 52 whose lower end is mounted on a shaft 53 extending between the housing walls, and whose intermediate section has a suitable bend 52*a*for cooperating with the lower edge of the operator 51. It will be seen in FIG. 8 that the bend 52*a* is so formed that the operator 51 when pivoted will be positively held in one of three positions, that is, a position in contact with the upper bulb 8*b*; a neutral position as shown; or a position in contact with the lower bulb 8*a*. The illuminating system includes the lower bulb 8*a*, which is disposed within a forwardly-directed parabolic relfector 8*c* and which when illuminated will shine light through a suitable protective lens 8*d* forwardly of the device to act as a flashlight for illuminating the surfaces to be cleaned by the sweep tunnel or any other purpose for which a flashlight may be used. The upper bulb 8*b*, which may be of a blinking or flashing type, is disposed within a translucent dome 8*e* fitted into an opening in the upper wall of the housing. The dome 8*e* may be of red or yellow plastic or glass so that when the bulb 8*b* is energized the flashing light through the dome will act as a warning marker or beacon, of particular value for use with an automobile when stopped on an unlit or poorly lit road or highway. All of the parts of the illuminating system are adapted to be inserted and snap-fitted into cooperating openings and tabs in the lighting compartment section 18 of the housing 10 as shown in FIG. 8.

For the purpose of simple construction and assembly the housing 10 is molded in two longitudinally-divided halves, 10*a* and 10*b*, of thermoplastic, with an overlapping seam flange 10*f* and appropriate internal receptacles 10*c* for screws 10*d* which fasten the halves together. Before the halves 10*a*, 10*b* are joined, all of the interior components may be assembled without the need for any special tooling by molding a number of supporting partitions within the device integrally with the housing walls and taking advantage of the resilience of the thermoplastic which permits insertion and snap fitting of the components into place. More particularly, as seen in FIG. 8, the insulating board of the forward wall 14*b* of the battery compartment 14 can be inserted into appropriate supporting ribs 101 on partitions 100*a* and 100*c* after the contact system 17 has been assembled thereon. The illuminating system may be similarly assembled by screwing the bulbs 8*a* and 8*b* into the angled contact member 50 and inserting one side of the contact member 50 into a suitable set of ribs 102 on the wall of, for example, housing half 10*a*. A matching set of ribs will be formed on half 10*b* to receive and support the other side of member 50 when the halves are joined. The switch operator 51 and the leaf spring 52 may also be mounted on half 10*a* by inserting one end of their support shafts 51*c* and 53, respectively, in appropriate apertures therein. The plunger 19 is insertable within the partitions 100*a* and 100*c* with its loading spring 23 mounted between partition 100*c* and flange 19*b*, and the motors 24 may be inserted into position within a compartment formed by support partition members 100*a* and 100*b*. To seal the electrical components from the dust and debris in the sweep tunnel, the mating edges of partition 100*b* may be fitted into an I-section seam strip 100*e* (FIG. 8*a*) also of thermoplastic material and held in place when halves 10*a* and 10*b* are joined. The drive gear 32 and idler roller 34 are inserted in their bearings 35 on half 10*a* and the sweeping belt 22 is mounted over them, after which the other housing half 10*b* is mated with half 10*a* and secured thereto by the screws 10*c* to hold all the parts in place. The external gearing assembly may then be connected together and mounted on the other wall of housing half 10*b* with gear 24*b* extending through the wall and engaging gear 36. The sweep tunnel may be provided with a one-piece removable lower wall 27 (FIGS. 1 and 7) that is insertable along ribs 103. The wall 27 may be removed for access to and cleaning of the sweeping belt 22 and provides a seamless floor for the tunnel facilitating its cleaning and preventing accumulation or escape of the dust being swept along it. The underside of the forward edge of wall 27 has a downwardly-extending tab 27*a* that may be gripped for inserting and removing wall 27. Additional ribs 27*b* are provided on either side of tab 27*a*, which ribs fit over and cooperate with indented portions 103*a* of ribs 103 at the intake opening 26 (see FIG. 5*a*) holding the two halves 10*a* and 10*b* together at the front of the tunnel 20. At the rear of the tunnel a transversely-extending rib or tab 10*e* is provided on the housing which is adapted to cooperate with the debris cup 16 to prop up the device as will be explained hereinafter.

Thus, except for the electrical connections of the lead wires to the contact members and motor, the entire device can be assembled or disassembled completely by hand requiring only a screw driver for convenience in inserting the fastening screws.

In operation the cleaning device is conveniently grasped by the rearwardly disposed handle, and the forward tunnel is manipulated and placed against a surface to be cleaned, with the intake opening 26 being substantially closed by the surface. The curved configuration of the upper wall 23 of the tunnel 20 and the forwardly-inclined opening 26 facilitate the reaching of snug areas and irregular surfaces. The button 21 forward of the handle is pressed down, against the action of spring 23 on the flange 19*b* of plunger 19, causing cam surface 19*a* on the lower end of the descending plunger rod 19*c* to act against cam portion 17*e* and press the bent end 17*f* of leaf spring 17*d* into contact with contact member 17*a*. This contact closes the circuit for energizing motor 24. Rotation of the motor shaft drives the gearing system causing movement of the sweeping belt 22 within the sweep tunnel 20. The belt 22 is preferably driven in a counterclockwise direction as viewed in FIG. 1 and causes the blade 22*a* disposed in the intake opening 26 to move to the rear of the tunnel 22 along the lower wall 27. This movement of the belt causes the blades 22*a* moving successively past the intake opening 26 to pick up and sweep to the rear of the tunnel any dust and particles on the engaged surface that may come in the way of the blades passing the intake opening 26. The opening 26 may be moved back and forth over, or drawn along the surface to be cleaned. The picked up dust and particles are drawn to the rear of the tunnel 22 by and between the blades and deposited in the material-receiving chamber 28. Any dust or particles collected in the material-receiving chamber 28 may be transferred to the debris cup 16 by merely tilting the cleaning device backwards. The motion of the blades 22*a* within the upper part of the material-retaining compartment 28 will tend to throw back any debris from the compartment which may tend to be regurgitated when the device is tilted forward. Similarly, the inclined lip or baffle 30 at the exit of chamber 28 will impede the spill back of any of the debris that has been received in the debris cup 16. When it is desired to empty the cup 16, it may be gripped at its sides and pulled back to slide it off the exit portion 28*a* of the material-retaining chamber 28. The debris cup 16 may then be cleaned before again being mounted on the device.

As cleaning devices of the present type are of particular usefulness as an accessory in automobiles, it is advantageous to have the illuminating system compactly incorporated therein to obviate the need for a separate battery-operated flashlight and/or warning beacon. In this regard, the debris cup 16 is adapted to act as a means for supporting the device when placed on a surface so that the flashlight or beacon can be suitably propped up, leaving the user's hands free to work on the automobile. To this end the transverse rib or tab 10*e* is provided on the underside of the housing at the rear of the sweep tunnel adjacent the material-receiving compartment 28, and the debris cup 16 is provided on its underside with two external ribs 16*c*. As seen in FIG. 2 the lower edge of the debris cup 16 may be inserted under the tab 103 with the ribs 16*c* disposed on either side of seam flange 10*f* and engaging the outer forward wall of the material-receiving chamber 28 to securely prop the device in an upwardly-inclined position. The device may also be positioned flat on a surface, supported by seam flange 10*f* and ribs 16*c*, or it may be slightly inclined by removing the debris cup 16 so that the weight of the batteries will tilt it back onto the exit portion 28*a* and its rear end, as respectively shown in FIGS. 1 and 3.

To use the flashlight in the device, switch operator 51 is rotated to its lower position completing the circuit through bulb 8*a*. If the device is to be used as a beacon, the operator 51 is pivoted to its uppermost position completing the circuit through bulb 8*b*. In both of these positions the operator 51 is held by the spring 52 so that the bulb will remain lit until the operator is again positively pivoted from the outside. On the other hand, when pressure is released on push-button 21 the spring 23 will move the plunger 19 upward, releasing the camming action on leaf spring 17*d* and opening the motor circuit. As a result, power cannot be inadvertently wasted by operation of the sweeping belt when the device is not being used for cleaning.

It will be seen that the particular configuration of the parts in the device minimizes its size and additionally makes the construction and assembly simple and inexpensive. The sweeping belt and tunnel provide a versatile, positive, and effective cleaning action with an efficient use of power, and all of the parts and their operation are combined in a simple, compact and optimal manner.

Various modifications may include the omission of part or all of the illuminating section or the prop arrangement and minor alterations in incidental portions such as the battery compartment or in the shapes of some of the members.

I claim:

1. A hand-held cleaning device comprising:

a housing having, forwardly-extending hollow tunnel means with a forwardly-inclined intake opening at its forward end for engaging a surface to be cleaned and taking in dust and debris from said surface;

handle means disposed rearwardly of said tunnel means for accommodating the hand of a user;

means defining a chamber disposed at the opposite end of said tunnel means from said intake opening for receiving dust and debris taken in through said intake opening; and debris cup means removably disposed in communication with said chamber for collecting dust and debris received therein;

sweeping means in said tunnel means for picking up dust and debris at said intake opening and delivering it to said chamber and comprising:

an elongated endless belt extending between said ends of said tunnel means, and having a series of ribs on its inner surface and spaced flexible upstanding blade means on its outer surface for engaging dust and debris at said intake opening; and means for mounting said endless belt in said tunnel means including gear means for engaging said ribs to drive said belt whereby said blade means moves through said tunnel means and past said intake opening;

motor means in said housing for producing a rotational output; and drive means operatively connecting said motor means to said gear means, for rotating said gear means to drive said belt.

2. A device as in claim 1 wherein said tunnel means comprises:

a flat lower wall;

side walls having lower ends connected to the opposite sides of said lower wall; and a flat top wall having a curved forward end extending beyond the forward end of said lower wall and cooperating with it and the forward ends of said sidewalls to form said forwardly-inclined intake opening.

3. A device as in claim 2 further comprising means on the lower ends of said sidewalls for removably mounting said lower wall.

4. A device as in claim 1 wherein said mounting means comprises:

said idler roller disposed in said tunnel means near said intake opening; and said gear means disposed near said chamber.

5. A device as in claim 4 wherein said motor means comprises an electric motor having rotating output shaft; and said drive means comprises transfer gear means, disposed outside of said housing and operatively connected between said output shaft and said gear means, for transferring the rotation of said output shaft to said gear means.

6. A device as in claim 1 wherein said belt, said blades and said ribs are integrally molded of thermoplastic.

7. A device as in claim 1 further comprising illuminating means disposed in said housing above said tunnel means for shining light from said housing.

8. A device as in claim 7 wherein said illuminating means comprises:

first bulb means for directing light forwardly from said housing and second bulb means for directing light upwardly from said housing;

means for providing power to light both of said bulb means;

operator means for alternately connecting said respective bulb means to said power means; and spring means for maintaining said operator means releasably in any one of three positions including a position in engagement with said first bulb means, a position in engagement with said second bulb means, and a position out of engagement with either of said bulb means.

9. A device as in claim 7 further comprising means on the underside of said tunnel means, cooperating with said debris cup means when removed, for supporting said housing in an inclined position.

10. A device as in claim 1 further comprising:

electric power means in said housing for energizing said motor means;

switch means for electrically connecting said power means in circuit with said motor means and comprising:

contact means for opening and closing said circuit and having a first conductive member conductively connected to said power means and a second conductive member conductively connected to said motor means, said second member having a camming surface thereon;

plunger means for conductively closing said contact means comprising:

a plunger having a push-button on one end extending out of said housing and a camming surface on its other end in engagement with the camming surface on said second member and cooperating therewith to press said said second member into contact with said first member when said push-button is pushed downwardly toward said housing; and spring means for urging said plunger outwardly from said housing.

11. A device as in claim 10 wherein said push-button is disposed immediately forward of said handle means.

12. A device as in claim 10 wherein said housing comprises two cooperating, axially-divided, molded plastic members having partition means integrally molded therein for mounting said motor means, said power means and said switch means.

13. A hand-held cleaning device comprising: a housing having, forwardly-extending hollow tunnel means with a forwardly-inclined intake opening at its forward end for engaging a surface to be cleaned and taking in dust and debris from said surface;

handle means disposed rearwardly of said tunnel means for accommodating the hand of a user;

means defining a chamber disposed at the opposite end of said tunnel means from said intake opening for receiving dust and debris taken in through said intake opening;

illuminating means disposed above the rear of said tunnel means for shining light from said housing;

sweeping means in said tunnel means for picking up dust and debris at said intake opening and delivering it to said chamber, said sweeping means comprising an elongated endless belt extending between said ends of said tunnel means, and having speed flexible upstanding blade means on its outer surface for engaging dust and debris at said intake; drive means for driving said belt to move said blade means through said tunnel means and past said intake opening; and debris cup means removably attached to the underside of the housing in communication with said chamber for collecting dust and debris received therein.

14. A device as in claim 13 further comprising means on the underside of said tunnel means, cooperating with said debris cup means when removed, for supporting said housing in an inclined position.

15. A device as in claim 13 wherein said illuminating means comprises:

first bulb means for directing light forwardly from said housing and second bulb means for directing light upwardly from said housing;

means for providing power to light both of said bulb means;

operator means for alternately connecting said respective bulb means to said power means; and spring means for maintaining said operator means releasably in any one of three positions including a position in engagement with said first bulb means, a position in engagement with said second bulb means, and a position out of engagement with either of said bulb means.

16. A device as in claim 15 wherein said housing comprises two cooperating, axially-divided, molded plastic members having means integrally molded therein for mounting said illuminating means.

17. A hand-held cleaning device comprising:

a housing having, forwardly-extending hollow tunnel means with a forwardly-inclined intake opening at its forward end for engaging a surface to be cleaned and taking in dust and debris from said surface;

handle means disposed rearwardly of said tunnel means for accommodating the hand of a user; and means defining a chamber disposed at the opposite end of said tunnel means from said intake opening for receiving dust and debris taken in through said opening;

sweeping means in said tunnel means for picking up dust and debris at said intake opening and delivering it to said chamber, said sweeping means comprising an elongated endless belt extending between said ends of said tunnel means, and having spaced flexible upstanding blade means on its outer surface for engaging dust and debris at said intake opening;

drive means for driving said sweeping means to move said blade means through said tunnel means and past said intake opening; and debris collecting means removably attached to said housing in communication with said chamber for collecting dust and debris received therein.

18. A device as in claim 17 wherein said drive means comprises:

an electric motor disposed in said housing and having an output shaft extending outside of said housing; and transfer gear means disposed outside of said housing and operatively connected between said output shaft and said sweeping means for transferring the rotation of said output shaft to said endless belt.

19. A device as in claim 18 further comprising:

electric power means in said housing for energizing said electric motor;

switch means for electrically connecting said power means in circuit with said electric motor and comprising:

contact means for opening and closing said circuit and having a first conductive member conductively connected to said power means and a second conductive member conductively connected to said electric motor, said second member having a camming surface thereon;

plunger means for conductively closing said contact means comprising:

a plunger having a push-button on one end extending out of said housing and a camming surface on its other end in engagement with the camming surface on said second member and cooperating therewith to press said second member into contact with said first member when said push-button is pushed downwardly toward said housing; and spring means for urging said plunger outwardly from said housing.

20. A device as in claim 19 wherein said push-button is disposed immediately forward of said handle means.

21. A device as in claim 19 wherein said housing comprises two cooperating, axially-divided molded plastic members having partition means integrally molded therein for mounting said electric motor, said power means and said switch means.

22. A device as in claim 21 further comprising means for sealing said partition means between said tunnel means and said electric motor.

* * * * *